US008108127B2

(12) United States Patent
Grunwald et al.

(10) Patent No.: US 8,108,127 B2
(45) Date of Patent: Jan. 31, 2012

(54) METHOD FOR INSPECTING A TANK VENTILATION DEVICE, CONTROL DEVICE, AND INTERNAL COMBUSTION ENGINE

(75) Inventors: Oliver Grunwald, Ingolstadt (DE); Oliver Prinz, Ingolstadt (DE)

(73) Assignee: Continental Automotive GmbH, Hannover (DE)

( * ) Notice: Subject to any disclaimer, the term of this patent is extended or adjusted under 35 U.S.C. 154(b) by 266 days.

(21) Appl. No.: 12/442,602

(22) PCT Filed: Sep. 5, 2007

(86) PCT No.: PCT/EP2007/059263

§ 371 (c)(1), (2), (4) Date: Nov. 25, 2009

(87) PCT Pub. No.: WO2008/037571

PCT Pub. Date: Apr. 3, 2008

(65) Prior Publication Data

US 2010/0101541 A1 Apr. 29, 2010

(30) Foreign Application Priority Data

Sep. 27, 2006 (DE) ..... 10 2006 045 678

(51) Int. Cl.
*F02M 33/02* (2006.01)

(52) U.S. Cl. ..... 701/107; 123/518; 123/198 D; 73/114.39

(58) Field of Classification Search ..... 123/518–519, 123/198 D; 701/107; 73/114.39, 114.43
See application file for complete search history.

(56) References Cited

U.S. PATENT DOCUMENTS

| | | | | |
|---|---|---|---|---|
| 5,143,035 | A | 9/1992 | Kayanuma | 123/198 D |
| 5,158,054 | A | 10/1992 | Otsuka | 123/198 D |
| 5,193,512 | A | 3/1993 | Steinbrenner et al. | 123/520 |
| 5,263,462 | A | 11/1993 | Reddy | 123/520 |
| 5,495,842 | A | 3/1996 | Yamanaka et al. | 123/520 |
| 6,530,265 | B2 | 3/2003 | Dawson et al. | 73/49.7 |
| 6,550,316 | B1 * | 4/2003 | Wong et al. | 73/49.7 |
| 6,658,923 | B2 | 12/2003 | Fabre | 73/118.1 |
| 6,722,189 | B2 * | 4/2004 | Fabre | 73/114.39 |
| 2009/0090171 | A1 * | 4/2009 | Grunwald et al. | 73/40.5 R |
| 2010/0071672 | A1 * | 3/2010 | Grunwald et al. | 123/520 |
| 2011/0079298 | A1 * | 4/2011 | Eser | 137/488 |

* cited by examiner

*Primary Examiner* — Hai Huynh
(74) *Attorney, Agent, or Firm* — King & Spalding L.L.P.

(57) ABSTRACT

A robust method, an accordingly designed control device, and an internal combustion engine, enables the proper performance of a tank ventilation device during the operation of the internal combustion engine. For this purpose, the position of a pressure switch of the tank ventilation device is detected, which indicates the pressure present in the tank ventilation device, a controllable tank ventilation valve, which is disposed in a connecting line between a fuel vapor accumulator and an intake pipe of the internal combustion engine, is opened at least partially during the operation of the internal combustion engine, the position of the pressure switch is again detected after opening of the tank ventilation valve, the proper performance of the tank ventilation device; is analyzed based on a comparison of the position of the pressure switch before opening the tank ventilation valve to the position of the pressure switch after opening the tank ventilation valve.

19 Claims, 3 Drawing Sheets

METHOD FOR INSPECTING A TANK VENTILATION DEVICE, CONTROL DEVICE, AND INTERNAL COMBUSTION ENGINE

CROSS-REFERENCE TO RELATED APPLICATIONS

This application is a United States national phase filing under 35 U.S.C. §371 of International Application No. PCT/EP2007/059263, filed Sep. 5, 2007 which claims priority to German Patent Application No. 10 2006 045 678.5, filed Sep. 27, 2006. The complete disclosure of the above-identified application is hereby fully incorporated herein by reference.

TECHNICAL FIELD

The invention relates to a method for checking a tank ventilation device, and to a control device that can be used to implement the method, and an internal combustion engine containing such a control device.

BACKGROUND

U.S. Pat. No. 5,263,462 discloses a method for checking a tank ventilation device.

The method makes use of the natural formation of a vacuum inside the tank ventilation device when an internal combustion engine is not running. According to the method, after turning off the internal combustion engine, the decrease in the coolant temperature is monitored by a temperature sensor. If the coolant temperature drops below a certain value, a check is made as to whether a pressure switch arranged in the tank ventilation device has closed. The closure of the pressure switch indicates formation of the natural vacuum inside the tank ventilation device, when the pressure switch is closed, one can therefore rule out a leak inside the tank ventilation device.

The disadvantage with this method is that it can only be performed when the internal combustion engine is not running, because the tank ventilation device only cools sufficiently sharply when the internal combustion engine is not running. Sufficient cooling, however, only occurs after a prolonged cooling period, which limits the feasibility of the method to periods in which the engine is off for prolonged intervals. Furthermore, the feasibility of the method also depends on the ambient temperature. If ambient temperatures are too high, the tank ventilation device does not cool sufficiently for the natural vacuum to form. Even when there is sufficient cooling, the amount by which the pressure drops is relatively small, so that the method is prone to errors and requires a large amount of calibration effort.

SUMMARY

According to various embodiments, a method for checking a tank ventilation device, plus a control device and an internal combustion engine can be provided, that enable a robust and frequent check of the tank ventilation device of the internal combustion engine.

According to an embodiment, a method for checking the proper operation of a tank ventilation device for an internal combustion engine, may comprise the steps of: detecting the position of a pressure switch of the tank ventilation device, wherein the pressure switch being in a low-pressure position if the pressure in the tank ventilation device is less than a specified threshold pressure, and otherwise being in a high-pressure position, when the internal combustion engine is running, opening at least partially a controllable tank ventilation valve of the tank ventilation device, which is arranged in a connecting pipe between a fuel-vapor storage system and an intake pipe of the internal combustion engine, and pneumatically connects the fuel vapor storage system and the intake pipe when in an open state, and pneumatically disconnects the fuel vapor storage system and the intake pipe when in a closed state, detecting the position of the pressure switch again after opening the tank ventilation valve, and assessing the proper operation of the tank ventilation device on the basis of a comparison of the position of the pressure switch before opening the tank ventilation valve with the position of the pressure switch after opening the tank ventilation valve.

According to a further embodiment, in the case that the pressure switch is in the high-pressure position both before opening and after opening the tank ventilation valve, a fault in the tank ventilation device can be identified. According to a further embodiment, in the case that the pressure switch is in the high-pressure position before opening the tank ventilation valve, the tank ventilation valve can be opened as far as a specified first degree of opening, the size of which is designed so that a pressure that is less than the threshold pressure is only established in the tank ventilation device when the tank ventilation device contains no leaks, and the tank ventilation device can be assessed as fault-free if the pressure switch is in the low-pressure position after opening the tank ventilation valve as far as the first degree of opening, otherwise a fault in the tank ventilation device is identified. According to a further embodiment, on identifying a fault in the tank ventilation device, the tank ventilation valve can be opened as far as a specified second degree of opening that is greater than the first degree of opening, the position of the pressure switch is detected after opening the tank ventilation valve as far as the second degree of opening, and if after opening the tank ventilation valve as far as the second degree of opening, the pressure switch is in the low-pressure position, the fault in the tank ventilation device can be identified as a leak. According to a further embodiment, the size of the second degree of opening can be designed so that a pressure that is lower than the threshold pressure is only established in the tank ventilation device when the size of the leak is smaller than a given threshold leak size, and if the position of the pressure switch after opening the tank ventilation valve as far as the second degree of opening is detected as the low-pressure position, the fault in the tank ventilation device is identified as a leak having a size that is smaller than the threshold leak size. According to a further embodiment, a functional check of the tank ventilation valve can be performed before opening the tank ventilation valve as far as the second degree of opening, and the tank ventilation valve is then only opened as far as the second degree of opening if the result of the functional check of the tank ventilation valve is that it is fault-free. According to a further embodiment, for the functional check of the tank ventilation valve, a check can be made as to whether an operating parameter of the internal combustion engine changes after actuating the tank ventilation valve. According to a further embodiment, the operating parameter may be the oxygen content of the exhaust gas from the internal combustion engine, which is measured by a Lambda sensor arranged in the exhaust section of the internal combustion engine.

According to another embodiment, a control device for an internal combustion engine, may be operable to detect the position of a pressure switch of a tank ventilation device of the motor vehicle, the pressure switch being in a low-pressure position if the pressure in the tank ventilation device is less than a specified threshold pressure, and otherwise being in a high-pressure position, to open, when the internal combustion engine is running, at least partially a controllable tank ventilation valve of the tank ventilation device, which is arranged in a connecting pipe between a fuel-vapor storage system and an intake pipe of an internal combustion engine of the motor vehicle, and pneumatically connects the fuel vapor storage system and the intake pipe when in an open state, and pneumatically disconnects the fuel vapor storage system and the intake pipe when in a closed state, to detect the position of the pressure switch again after opening the tank ventilation valve, and to assess the proper operation of the tank ventilation device on the basis of a comparison of the position of the pressure switch before opening the tank ventilation valve with the position of the pressure switch after opening the tank ventilation valve.

According to a further embodiment, in the case that the pressure switch is in the high-pressure position both before opening and after opening the tank ventilation valve, a fault in the tank ventilation device may be identified. According to a further embodiment, in the case that the pressure switch is in the high-pressure position before opening the tank ventilation valve, the tank ventilation valve can be opened as far as a specified first degree of opening, the size of which is designed so that a pressure that is less than the threshold pressure is only established in the tank ventilation device when the tank ventilation device contains no leaks, and the tank ventilation device can be assessed as fault-free if the pressure switch is in the low-pressure position after opening the tank ventilation valve as far as the first degree of opening, otherwise a fault in the tank ventilation device is identified. According to a further embodiment, on identifying a fault in the tank ventilation device, the tank ventilation valve can be opened as far as a specified second degree of opening that is greater than the first degree of opening, the position of the pressure switch can be detected after opening the tank ventilation valve as far as the second degree of opening, and if after opening the tank ventilation valve as far as the second degree of opening, the position of the pressure switch can be detected as the low-pressure position, the fault in the tank ventilation device is identified as a leak. According to a further embodiment, the size of the second degree of opening can be designed so that a pressure that is lower than the threshold pressure is only established in the tank ventilation device when the size of the leak is smaller than a given threshold leak size, and if the position of the pressure switch after opening the tank ventilation valve as far as the second degree of opening is detected as the low-pressure position, the fault in the tank ventilation device can be identified as a leak having a size that is smaller than the threshold leak size. According to a further embodiment, a functional check of the tank ventilation valve can be performed before opening the tank ventilation valve as far as the second degree of opening, and the tank ventilation valve is then only opened as far as the second degree of opening if the result of the functional check of the tank ventilation valve is that it is fault-free. According to a further embodiment, for the functional check of the tank ventilation valve, a check can be made as to whether an operating parameter of the internal combustion engine changes after actuating the tank ventilation valve. According to a further embodiment, the operating parameter can be the oxygen content of the exhaust gas from the internal combustion engine, which is measured by a Lambda sensor arranged in the exhaust section of the internal combustion engine.

According to yet another embodiment, an internal combustion engine may contain such a control device.

BRIEF DESCRIPTION OF THE DRAWINGS

The invention is described in greater detail below using an exemplary embodiment with reference to the appended figure, in which.

DETAILED DESCRIPTION

Figure 1:
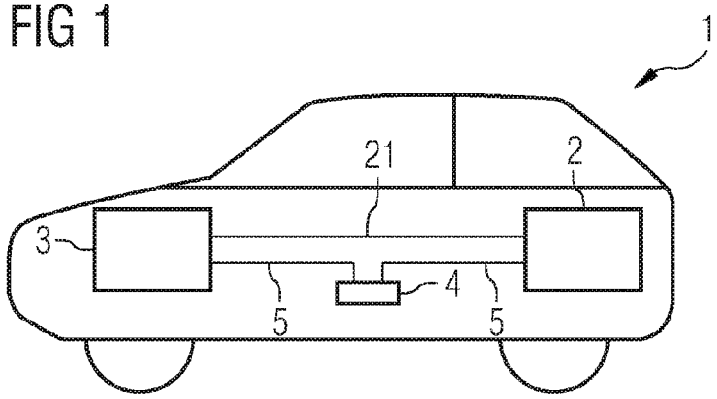
FIG. 1 shows a schematic diagram of an motor vehicle containing an internal combustion engine and a tank ventilation device.

In the method for checking the proper operation of a tank ventilation device for an internal combustion engine according to an embodiment, the position of a pressure switch of the tank ventilation device is detected first. The pressure switch is in a low-pressure position if there is a pressure in the tank ventilation device that is less than a specified threshold pressure, and is otherwise in a high-pressure position. A controllable tank ventilation valve is arranged in a connecting pipe between a fuel-vapor storage vessel of the tank ventilation device and an intake pipe of the internal combustion engine, said ventilation valve pneumatically connecting the storage vessel and the intake pipe when in an open state, and pneumatically disconnecting the storage vessel and the intake pipe when in a closed state. According to the method, the controllable tank ventilation valve is opened at least partially when the internal combustion engine is running. The position of the pressure switch is detected again after opening the tank ventilation valve. The proper operation of the tank ventilation device is then assessed on the basis of a comparison of the position of the pressure switch before opening the tank ventilation valve with the position after opening the tank ventilation valve.

The method according to an embodiment enables the proper operation of the tank ventilation device to be checked while the internal combustion engine is running. By virtue of the fact that there is a strong vacuum in the intake pipe when the internal combustion engine is running under partial load, which is its most frequent operating state, a sufficiently large pressure drop in the tank ventilation device can be achieved within a very short time by opening the tank ventilation valve. Hence the method takes little time to perform and can be carried out during almost the entire running time of the internal combustion engine. Therefore the frequency at which the method can be performed is very high. Since the vacuum in the intake pipe is suitably strong precisely when the internal combustion engine is running under partial load, the pressure in the tank ventilation device can be reduced correspondingly sharply by suitable actuation of the tank ventilation valve. This means that the method is insensitive to fluctuations in the ambient temperature, making the method immune to errors and reducing the calibration effort.

According to a further embodiment, in the case that the pressure switch is in the high-pressure position both before opening the tank ventilation valve and after opening the tank ventilation valve, a fault in the tank ventilation device is identified.

Opening the tank ventilation valve results in a gas flow from the tank ventilation device to the intake pipe because of the vacuum in the intake pipe. In a fault-free tank ventilation device, this would produce a reduction in pressure, so that the pressure in the tank ventilation device would fall below the threshold pressure. In these circumstances, the pressure switch would switch from the high-pressure position into the low-pressure position. If the pressure switch is in the high-pressure position both before and after opening the tank ventilation valve, this is taken as reliable evidence of a fault in the tank ventilation device. Possible faults include, for example, a faulty pressure switch, a defective tank ventilation valve or a leak, through which occurs the unwanted ingress of air from outside into the tank ventilation device and which can hence prevent a drop in pressure.

According to a further embodiment, in the case that the pressure switch is in the high-pressure position before opening the tank ventilation valve, the tank ventilation valve is opened as far as a specified first degree of opening. The size of the first degree of opening is designed so that a pressure that is less than the threshold pressure is only established in the tank ventilation device when the tank ventilation device contains no leaks. The tank ventilation device is assessed as fault-free if the pressure switch is in the low-pressure position after opening the tank ventilation valve as far as the first degree of opening. Otherwise a fault in the tank ventilation device is identified.

This embodiment of the method enables reliable identification of a fault-free tank ventilation system. Suitable calibration of the first degree of opening prevents the tank ventilation valve from being opened to such an extent that the pressure in the tank ventilation device drops below the threshold pressure even when there is a leak in the tank ventilation device. This situation would arise if the tank ventilation valve is opened so wide that the gas flow from the tank ventilation device via the tank ventilation valve to the intake pipe is greater than the amount of air entering through the leak from outside. If after opening the tank ventilation valve as far as the first degree of opening the pressure switch switches from the high-pressure position into the low-pressure position, this constitutes evidence of the proper operation of the tank ventilation valve and of the pressure switch, and as evidence that the tank ventilation device contains no leaks.

According to a further embodiment, on identifying a fault in the tank ventilation device, the tank ventilation valve is opened as far as a specified second degree of opening that is greater than the first degree of opening. Then the position of the pressure switch is detected after opening the tank ventilation valve as far as the second degree of opening. If after opening the tank ventilation valve as far as the second degree of opening, the pressure switch is in the low-pressure position, the fault in the tank ventilation device is identified as a leak.

This embodiment of the method is based on the knowledge that when opening the tank ventilation valve as far as the second degree of opening, the gas flow from the tank ventilation device to the intake pipe of the internal combustion engine is so strong that if there is a leak present, the amount of air entering from outside through this leak is not sufficient to prevent the pressure inside the tank ventilation device from dropping below the specified threshold pressure. Thus, if the position of the pressure switch after opening the tank ventilation valve as far as this second degree of opening is identified as the low-pressure position, the fault can be pinpointed to a leak in the tank ventilation device. The pressure switch and the tank ventilation valve, on the other hand, are working correctly. Hence this procedure makes it possible to pinpoint the identified fault.

According to a further embodiment, the size of the second degree of opening is designed so that a pressure that is lower than the threshold pressure is only established in the tank ventilation device when the size of the leak is smaller than a given size.

In this embodiment of the method, the second degree of opening is calibrated so that the amount of air from outside entering via an existing leak that is smaller than a given threshold leak size, is not enough to compensate for the gas flow out of the tank ventilation device into the intake pipe. If the pressure switch switches from a high-pressure position into the low-pressure position after opening the tank ventilation valve as far as the second degree of opening, then this is taken as evidence that the leak in the tank ventilation device is smaller than the threshold leak size. Hence this embodiment of the method enables a more informative, rough estimate of the leak.

According to a further embodiment, a functional check of the tank ventilation valve is performed before opening the tank ventilation valve as far as the second degree of opening. The tank ventilation valve is then only opened as far as the second degree of opening if the result of the functional check is that the tank ventilation valve is fault-free.

This embodiment ensures that the tank ventilation valve is not stuck in a closed position. This is a necessary condition for identifying a leak in the tank ventilation device.

According to further embodiments, in order to assess the proper operation of the tank ventilation valve, a check is made as to whether an operating parameter of the internal combustion engine changes after actuating the tank ventilation valve or after opening the tank ventilation valve. This operating parameter may be, for example, the oxygen content of the exhaust gas from the internal combustion engine, which is measured by a Lambda sensor arranged in the exhaust section of the internal combustion engine.

These embodiments allow the functional check of the tank ventilation valve to be performed reliably and using sensors already present in the internal combustion engine. By opening the tank ventilation valve, fuel vapors flow from the tank ventilation device into the intake pipe and are involved in the combustion process. This results in a change in the exhaust-gas composition. If the fuel composition remains unchanged, it is assumed that the tank ventilation valve is stuck in the closed position.

The control device according to further embodiments is embodied such that it can implement the above described method. Reference is made to these method embodiments in respect of the advantages.

An internal combustion engine according to a further embodiment may comprise such a control device. In this case reference is again made to the method embodiments in respect of the advantages.

FIG. 1 shows a schematic diagram of an motor vehicle 1 comprising an internal combustion engine 2 and a tank ventilation device 3. The tank ventilation device 3 is connected to the internal combustion engine 2 via a connecting pipe 21. The motor vehicle 1 also comprises a control device 4, which can be used to control the processes in the internal combustion engine 2 and the tank ventilation device 3. For this purpose, the control device 4 is connected to the tank ventilation device 3 and the internal combustion engine 2 via data lines and signal lines 5.

Figure 2:
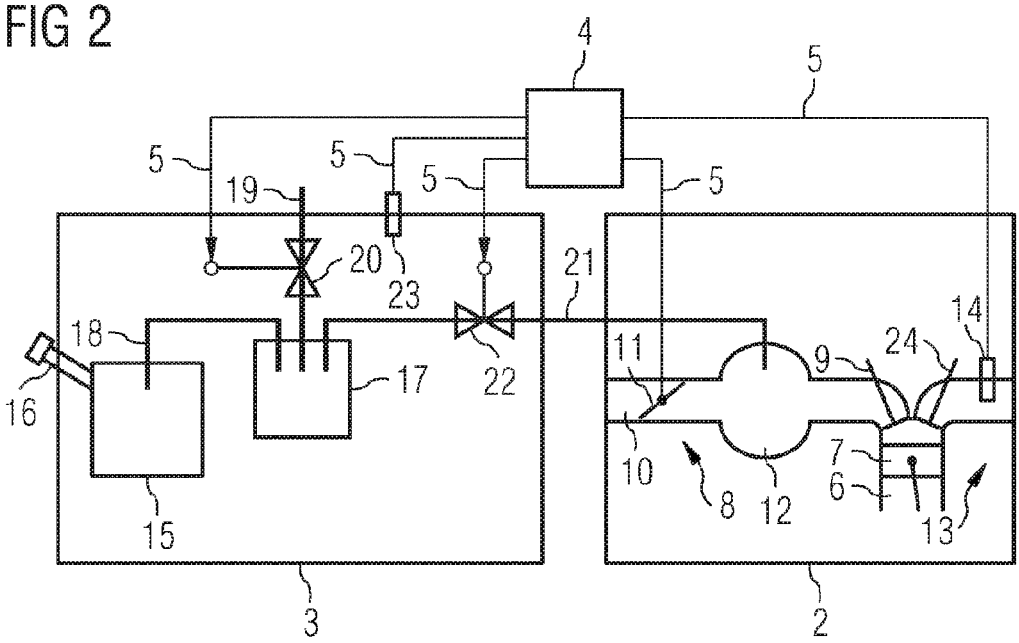
FIG. 2 shows a schematic detailed view of the tank ventilation device and the internal combustion engine.

FIG. 2 shows the tank ventilation device 3, the internal combustion engine 2 and the control device 4 in detail. In order to improve clarity, the diagram is confined to those components necessary to explaining the invention.

The internal combustion engine 2 comprises a cylinder 6 and a piston 7 that can move up and down in the cylinder 6. The fresh air required for combustion is supplied via an intake section 8 to the combustion chamber defined by the cylinder 6 and the piston 7. The intake section 8 and the combustion chamber are selectively connected or disconnected via an intake valve 9. A controllable throttle valve 11, which can be used to adjust the air mass flow rate in the combustion chamber, is located downstream of an intake port 10 of the intake section 8, at which fresh air is drawn in. An intake pipe 12 is located downstream of the throttle valve 11. The combustion gases are expelled via an exhaust section 13. The combustion chamber and the exhaust section 13 are selectively disconnected or connected via an outlet valve 24. A Lambda sensor 14 is arranged in the exhaust section 13 in order to measure the exhaust-gas composition or the oxygen content of the exhaust gas.

The control device 4 is connected to the Lambda sensor 14 and to the throttle valve 11 via data lines and signal lines 5. The control device 4 can hence access the reading from the Lambda sensor 14 and control the throttle valve 11.

The tank ventilation system comprises a fuel tank 15 into which fuel can be supplied via an input pipe 16. In addition, a fuel vapor storage system 17, for example an activated charcoal filter, is provided, which adsorbs the fuel vapors. The fuel vapor storage system 17 is connected via a further connecting pipe 18 to the fuel tank 15, so that the fuel vapors given off there are conducted into the fuel vapor storage system 17 and adsorbed there. The fuel vapor storage system 17 can also be connected to the outside environment via a ventilation pipe 19 and a controllable ventilation valve 20 arranged therein. The fuel vapor storage system 17 can be connected pneumatically to the intake pipe 12 of the internal combustion engine 2 via the connecting pipe 21 and a controllable tank ventilation valve 22 arranged therein. When the tank ventilation valve 22 is open, the fuel vapor storage system 17 is pneumatically connected to the intake pipe 12, whereas the fuel vapor storage system 17 is pneumatically disconnected from the intake pipe 12 when the tank ventilation valve 22 is closed. The pressure in the tank ventilation system is detected by a pressure switch 23. The pressure switch 23 is designed so that it is in a low-pressure position when the pressure in the tank ventilation device 3 is less than a specified threshold pressure, and otherwise is in a high-pressure position.

The tank ventilation valve 22 and the ventilation valve 20 are connected via data lines and signal lines 5 to the control device 4, and can be controlled by it. The degree of opening of the tank ventilation valve 22 is infinitely adjustable by the control device 4. In addition, the pressure switch 23 is connected to the control device 4 via data lines and signal lines 5 so that the control device can detect the current position of the pressure switch 23.

Figure 3:
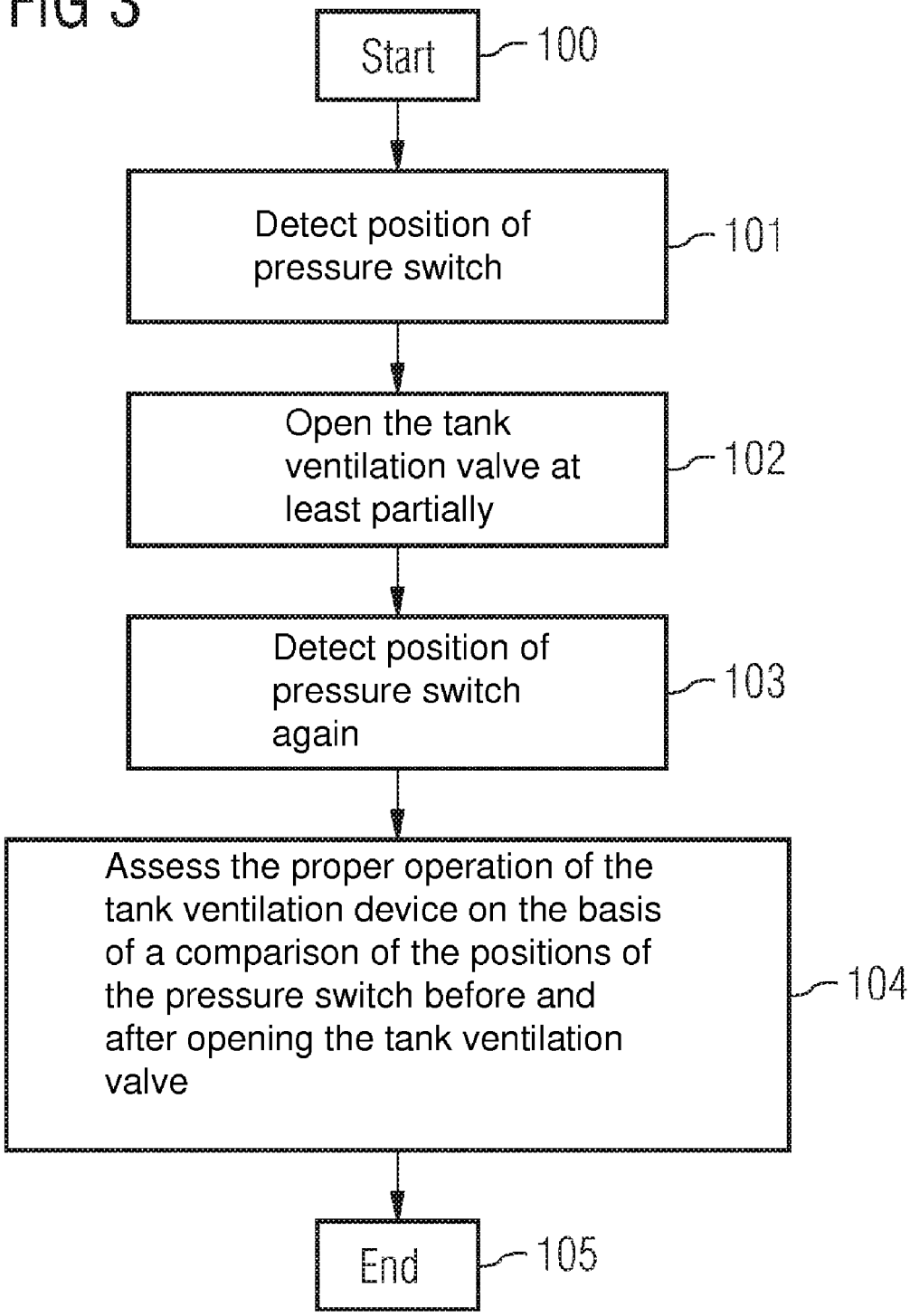
FIG. 3 shows a flow diagram of the method in a general form.

In FIG. 3, the method according to an embodiment is shown in a general form as a flow diagram. After the start of the method in step 100, the position of the pressure switch 23 is detected in step 101. Then in step 102, the tank ventilation valve 22 is opened at least partially so that the tank ventilation device 3 is pneumatically connected to the intake pipe 12. There is a vacuum in the intake pipe 12, at least when the internal combustion engine 2 is running under partial load, so that opening the tank ventilation valve 22 results in a gas flow from the tank ventilation device 3 or from the fuel vapor storage system 17 to the intake pipe 12 of the internal combustion engine 2. After a certain time, the position of the pressure switch 23 is detected again in step 103. The proper operation of the tank ventilation device 3 is assessed as shown in step 104 on the basis of a comparison of the position of the pressure switch 23 before opening the tank ventilation valve 22 with the position of the pressure switch 23 after opening the tank ventilation valve 22.

As already mentioned earlier, this method allows a functional check of the tank ventilation device 3 while the internal combustion engine 2 is running. Since the internal combustion engine 2 is running under partial load for most of the time, i.e. with the throttle valve 11 only partially open, the functional check of the tank ventilation device 3 is possible during practically the entire running time of the internal combustion engine 2. This allows the frequency of the check of the tank ventilation device 3 to be increased significantly. In addition, because extremely low pressures exist in the intake pipe 12 precisely in the lower partial-load region of the internal combustion engine 2, a sharp pressure drop in the tank ventilation system is possible, making the check of the tank ventilation device 3 more robust and allowing more precise identification of existing faults. This is explained below with reference to the exemplary embodiment of the method shown in FIG. 4.

Figure 4:
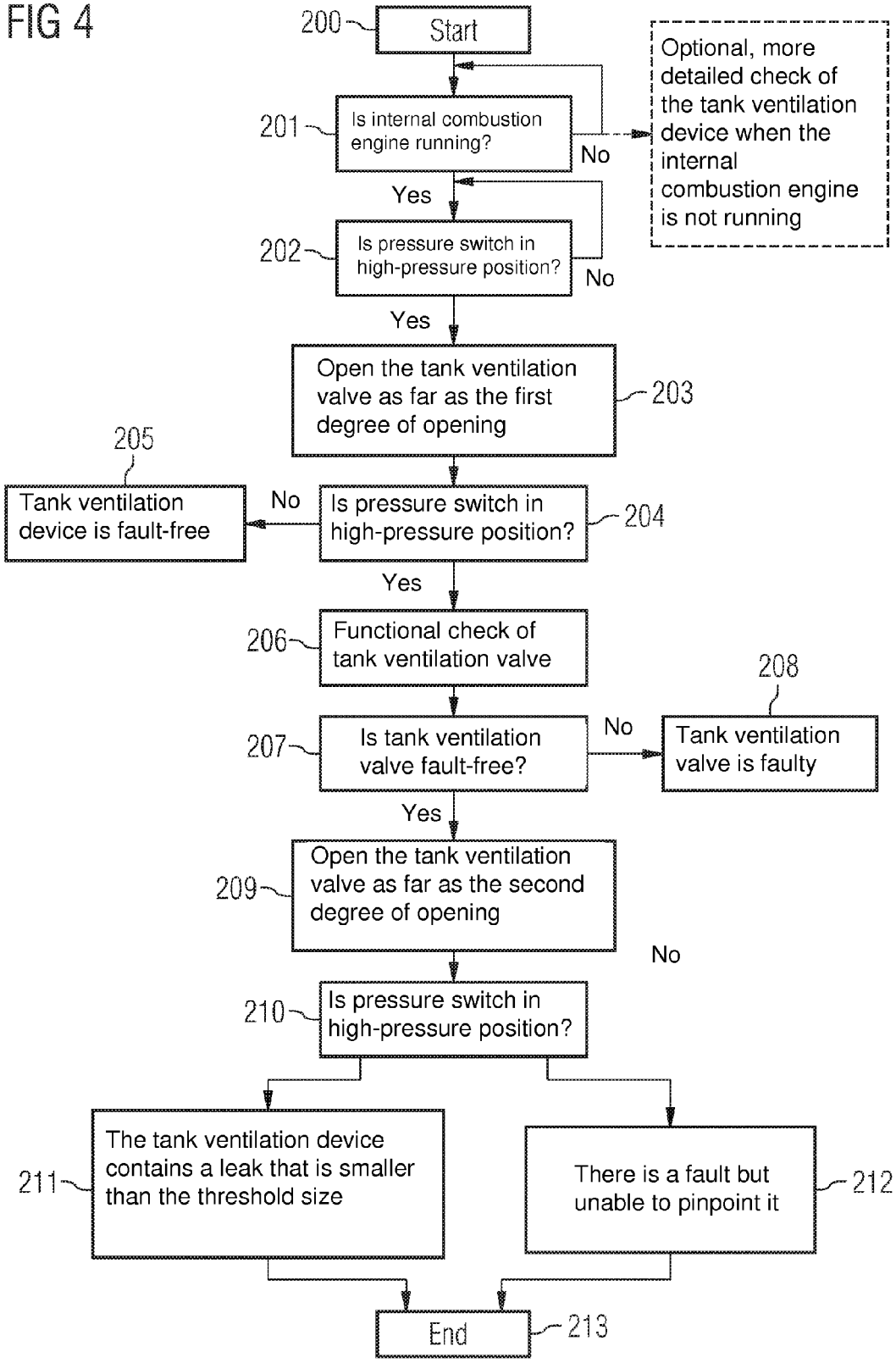
FIG. 4 shows a flow diagram of an exemplary embodiment of the method.

FIG. 4 shows as a flow diagram an advantageous exemplary embodiment of the method for checking the tank ventilation valve 22.

After the start of the method in step 200, a check is initially performed in step 201 as to whether the internal combustion engine 2 is running. If this is not the case, this question is repeated. Alternatively it is also possible here to move on to another procedure for checking the proper operation of the tank ventilation device 3 when the internal combustion engine 2 is not running, as is known from the prior art for example.

If it is established in step 201 that the internal combustion engine 2 is running, the method moves on to step 202 in which a check is performed as to whether the pressure switch 23 is in the high-pressure position. If this is not the case, the question is repeated.

In the case that the pressure switch 23 is in the high-pressure position, the tank ventilation valve 22 is opened as far as a first degree of opening in step 203. The first degree of opening can be calibrated here so that the pressure in the tank ventilation device 3 only falls to below the threshold pressure if the tank ventilation device 3 contains no leaks i.e. is airtight. On opening the tank ventilation valve 22 as far as the first degree of opening, a gas flow is established from the tank ventilation device 3 or the fuel vapor storage system 17 towards the intake pipe 12 that is so low that the pressure in the tank ventilation device falls below the threshold pressure, and the pressure switch 23 switches into the low-pressure position, only if the tank ventilation device 3 does not contain a leak. In the event of a leak in the tank ventilation device 3, the pressure in the tank ventilation device 3 does not fall below the threshold pressure because of the air entering from outside, which means that the pressure switch 23 remains in the high-pressure position.

After opening the tank ventilation valve 22 as far as the first degree of opening, in step 204 the position of the pressure switch 23 is detected again and checked to determine whether the pressure switch 23 is in the high-pressure position. If this is not the case, i.e. the pressure switch 23 is in the low-pressure position, the tank ventilation device 3 can be assessed in step 205 as fault-free. This is justifiable because the switching of the pressure switch 23 from the high-pressure position into the low-pressure position proves that the pressure switch 23 is operating properly. At the same time, this is also evidence that the tank ventilation valve 22 has opened properly, because otherwise a drop in pressure in the tank ventilation device 3 would not have been possible. Hence the tank ventilation valve 22 is also presumed to be working properly. Since the first degree of opening of the tank ventilation valve 22 is calibrated so that a pressure drop in the tank ventilation device 3 below the threshold pressure, and hence switching of the pressure switch 23 into the low-pressure position, is only possible when the tank ventilation device 3 contains no leaks, the fact that the tank ventilation device 3 contains no leaks is also proven by the pressure switch 23 assuming the low-pressure position.

On the other hand, if it is identified in step 204 that the pressure switch 23 remains in the high-pressure position, a functional check of the tank ventilation valve 22 is performed in step 206.

A functional check of the tank ventilation valve 22 can be performed, for example, by the tank ventilation valve 22 being opened while the internal combustion engine 2 is running, and checking whether there is a change in an operating parameter of the internal combustion engine 2. More precisely, opening the tank ventilation valve 22 results in a purge effect of the fuel vapor storage system 17, so that the fuel vapors stored in the activated charcoal filter are supplied to the combustion chamber of the internal combustion engine 2 via the intake pipe 12 in the intake valve 9, and are involved in the combustion. This changes the composition of the combustion mixture, which in turn causes an altered exhaust-gas composition, which is detected by the Lambda sensor 14. If after opening the tank ventilation valve 22, a change in the exhaust-gas composition is detected by the Lambda sensor 14, then sticking of the tank ventilation valve 22 in the closed state can be ruled out and the tank ventilation valve 22 can be assessed to be working.

If it is recognized in step 207 that the tank ventilation valve 22 is faulty, this is identified as a fault in the tank ventilation device 3. There is no longer any point in continuing a functional check of the tank ventilation device 3 at this point, so the process is terminated with step 208.

On the other hand, if the tank ventilation valve 22 is assessed as fault-free in step 207, the tank ventilation valve 22 is opened to a second degree of opening in step 209 that is larger than the first degree of opening. The second degree of opening can be calibrated here so that the tank ventilation valve 22 is fully opened or only so wide that the pressure inside the tank ventilation device 3 only drops below the threshold pressure when the size of any leak is smaller than a given threshold leak size. The size of the leak in this context can be taken to mean, for example, the surface area of the leak aperture.

In step 210, the position of the pressure switch 23 after opening the tank ventilation valve 22 as far as the second degree of opening is detected. If the pressure switch 23 is in the low-pressure position, the fault in the tank ventilation device 3 is initially identified in step 211 as a leak. This conclusion is justifiable because a fault in the tank ventilation valve 22 can be ruled out thanks to the previous positive functional check. In addition, a fault in the pressure switch 23 must also be ruled out by the switching of the pressure switch 23 from the high-pressure position into the low-pressure position. Consequently the only remaining possibility is a leak in the tank ventilation device 3. It can also be concluded from the switching of the pressure switch 23 into the low-pressure position after opening the tank ventilation valve 22 as far as the second degree of opening, that the leak in the tank ventilation system is of a size that is smaller than the threshold leak size. This is based on the fact that the gas flow from the tank ventilation device 3 via the tank ventilation valve 22 into the intake pipe 12 when the tank ventilation valve 22 is opened as far as the second degree of opening is greater than the amount of air entering from outside through the leak. Since any size can be calibrated for the threshold leak size, leaks of any size can be identified.

If it is identified in step 210 that the pressure switch 23 is in the high-pressure position, it is not possible to pinpoint the fault in the tank ventilation device 3 more closely in step 212. Possible faults include, in particular, a leak whose size is greater than the threshold leak size, a fault in the pressure switch 23 or a missing fuel cap on the fuel tank 15 of the tank ventilation device 3.

The method ends in step 213.

In this embodiment of the method, not only is it possible to identify a fault in the tank ventilation device 3 when the internal combustion engine 2 is running, but the fault can also be pinpointed more precisely. In addition, the size of a possible leak can be estimated roughly by suitable calibration of the first and second degrees of opening. The method is inexpensive because it does not require any components over and above those that are today built-in as standard in most internal combustion engines.

LIST OF REFERENCE CHARACTERS

1 Motor vehicle
2 Internal combustion engine
3 Tank ventilation device
4 Control device
5 Data lines and control lines
6 Cylinder
7 Piston
8 Intake section
9 Intake valve
10 Intake port
11 Throttle valve
12 Intake pipe
13 Exhaust section
14 Lambda sensor
15 Fuel tank
16 Input pipe
17 Fuel vapor storage system
18 Connecting pipe
19 Ventilation pipe
20 Ventilation valve
21 Additional connecting pipe
22 Tank ventilation valve
23 Pressure switch

The invention claimed is:

1. A method for checking the proper operation of a tank ventilation device for an internal combustion engine, comprising the steps of:

detecting the position of a pressure switch of the tank ventilation device, wherein the pressure switch being in a low-pressure position if the pressure in the tank ventilation device is less than a specified threshold pressure, and otherwise being in a high-pressure position, when the internal combustion engine is running, opening at least partially a controllable tank ventilation valve of the tank ventilation device, which is arranged in a connecting pipe between a fuel-vapor storage system and an intake pipe of the internal combustion engine, and pneumatically connects the fuel vapor storage system and the intake pipe when in an open state, and pneumatically disconnects the fuel vapor storage system and the intake pipe when in a closed state, detecting the position of the pressure switch again after opening the tank ventilation valve, assessing the proper operation of the tank ventilation device on the basis of a comparison of the position of the pressure switch before opening the tank ventilation valve with the position of the pressure switch after opening the tank ventilation valve.

2. The method according to claim 1, wherein in the case that the pressure switch is in the high-pressure position both before opening and after opening the tank ventilation valve, a fault in the tank ventilation device is identified.

3. The method according to claim 1, wherein in the case that the pressure switch is in the high-pressure position before opening the tank ventilation valve, the tank ventilation valve is opened as far as a specified first degree of opening, the size of which is designed so that a pressure that is less than the threshold pressure is only established in the tank ventilation device when the tank ventilation device contains no leaks, and the tank ventilation device is assessed as fault-free if the pressure switch is in the low-pressure position after opening the tank ventilation valve as far as the first degree of opening, otherwise a fault in the tank ventilation device is identified.

4. The method according to claim 3, wherein on identifying a fault in the tank ventilation device the tank ventilation valve is opened as far as a specified second degree of opening that is greater than the first degree of opening, the position of the pressure switch is detected after opening the tank ventilation valve as far as the second degree of opening, and if after opening the tank ventilation valve as far as the second degree of opening, the pressure switch is in the low-pressure position, the fault in the tank ventilation device is identified as a leak.

5. The method according to claim 4, wherein the size of the second degree of opening is designed so that a pressure that is lower than the threshold pressure is only established in the tank ventilation device when the size of the leak is smaller than a given threshold leak size, and if the position of the pressure switch after opening the tank ventilation valve as far as the second degree of opening is detected as the low-pressure position, the fault in the tank ventilation device is identified as a leak having a size that is smaller than the threshold leak size.

6. The method according to claim 4, wherein a functional check of the tank ventilation valve is performed before opening the tank ventilation valve as far as the second degree of opening, and the tank ventilation valve is then only opened as far as the second degree of opening if the result of the functional check of the tank ventilation valve is that it is fault-free.

7. The method according to claim 6, wherein for the functional check of the tank ventilation valve, a check is made as to whether an operating parameter of the internal combustion engine changes after actuating the tank ventilation valve.

8. The method according to claim 7, wherein the operating parameter is the oxygen content of the exhaust gas from the internal combustion engine, which is measured by a Lambda sensor arranged in the exhaust section of the internal combustion engine.

9. The method according to claim 5, wherein a functional check of the tank ventilation valve is performed before opening the tank ventilation valve as far as the second degree of opening, and the tank ventilation valve is then only opened as far as the second degree of opening if the result of the functional check of the tank ventilation valve is that it is fault-free.

10. A control device for an internal combustion engine, which is operable to detect the position of a pressure switch of a tank ventilation device of the motor vehicle, the pressure switch being in a low-pressure position if the pressure in the tank ventilation device is less than a specified threshold pressure, and otherwise being in a high-pressure position, open, when the internal combustion engine is running, at least partially a controllable tank ventilation valve of the tank ventilation device, which is arranged in a connecting pipe between a fuel-vapor storage system and an intake pipe of an internal combustion engine of the motor vehicle , and pneumatically connects the fuel vapor storage system and the intake pipe when in an open state, and pneumatically disconnects the fuel vapor storage system and the intake pipe when in a closed state, detect the position of the pressure switch again after opening the tank ventilation valve, and to assess the proper operation of the tank ventilation device on the basis of a comparison of the position of the pressure switch before opening the tank ventilation valve with the position of the pressure switch after opening the tank ventilation valve.

11. The control device according to claim 10, wherein in the case that the pressure switch is in the high-pressure position both before opening and after opening the tank ventilation valve, a fault in the tank ventilation device is identified.

12. The control device according to claim 10, wherein in the case that the pressure switch is in the high-pressure position before opening the tank ventilation valve, the tank ventilation valve is opened as far as a specified first degree of opening, the size of which is designed so that a pressure that is less than the threshold pressure is only established in the tank ventilation device when the tank ventilation device contains no leaks, and the tank ventilation device is assessed as fault-free if the pressure switch is in the low-pressure position after opening the tank ventilation valve as far as the first degree of opening, otherwise a fault in the tank ventilation device is identified.

13. The control device according to claim 12, wherein on identifying a fault in the tank ventilation device the tank ventilation valve is opened as far as a specified second degree of opening that is greater than the first degree of opening, the position of the pressure switch is detected after opening the tank ventilation valve as far as the second degree of opening, and if after opening the tank ventilation valve as far as the second degree of opening, the position of the pressure switch is detected as the low-pressure position, the fault in the tank ventilation device is identified as a leak.

14. The control device according to claim 13, wherein the size of the second degree of opening is designed so that a pressure that is lower than the threshold pressure is only established in the tank ventilation device when the size of the leak is smaller than a given threshold leak size, and if the position of the pressure switch after opening the tank ventilation valve as far as the second degree of opening is detected as the low-pressure position, the fault in the tank ventilation device is identified as a leak having a size that is smaller than the threshold leak size.

15. The control device according to claim 13, wherein a functional check of the tank ventilation valve is performed before opening the tank ventilation valve as far as the second degree of opening, and the tank ventilation valve is then only opened as far as the second degree of opening if the result of the functional check of the tank ventilation valve is that it is fault-free.

16. The control device according to claim 15, wherein for the functional check of the tank ventilation valve, a check is made as to whether an operating parameter of the internal combustion engine changes after actuating the tank ventilation valve.

17. The control device according to claim 16, wherein the operating parameter is the oxygen content of the exhaust gas from the internal combustion engine, which is measured by a Lambda sensor arranged in the exhaust section of the internal combustion engine.

18. The control device according to claim 14, wherein a functional check of the tank ventilation valve is performed before opening the tank ventilation valve as far as the second degree of opening, and the tank ventilation valve is then only opened as far as the second degree of opening if the result of the functional check of the tank ventilation valve is that it is fault-free.

19. An internal combustion engine containing a control device according to claim 10.

* * * * *